US012410815B2

(12) United States Patent
Hsieh et al.

(10) Patent No.: US 12,410,815 B2
(45) Date of Patent: Sep. 9, 2025

(54) AXIAL-FLOW HEAT-DISSIPATION FAN

(71) Applicant: Acer Incorporated, New Taipei (TW)

(72) Inventors: Cheng-Wen Hsieh, New Taipei (TW); Mao-Neng Liao, New Taipei (TW); Kuang-Hua Lin, New Taipei (TW); Wei-Chin Chen, New Taipei (TW); Tsung-Ting Chen, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 18/830,598

(22) Filed: Sep. 11, 2024

(65) Prior Publication Data

US 2025/0084869 A1 Mar. 13, 2025

(30) Foreign Application Priority Data

Sep. 12, 2023 (TW) ..... 112134706

(51) Int. Cl.
*F04D 19/00* (2006.01)
*F04D 29/32* (2006.01)
*F04D 29/52* (2006.01)

(52) U.S. Cl.
CPC ..... *F04D 29/522* (2013.01); *F04D 19/002* (2013.01); *F04D 29/325* (2013.01)

(58) Field of Classification Search
CPC .... F04D 29/522; F04D 19/002; F04D 29/667; F04D 29/68
See application file for complete search history.

(56) References Cited

U.S. PATENT DOCUMENTS 8,403,633 B2 * 3/2013 Hwang ..... F04D 25/0613 415/206

FOREIGN PATENT DOCUMENTS

| | | | |
|---|---|---|---|
| CN | 114215773 | | 3/2022 |
| TW | 201219666 A | * | 5/2012 |
| TW | I428511 | | 3/2014 |

* cited by examiner

*Primary Examiner* — Sabbir Hasan

(74) *Attorney, Agent, or Firm* — JCIPRNET

(57) ABSTRACT

An axial-flow heat-dissipation fan including a frame and a blade wheel is provided. The frame has an inlet, an outlet, and an inner wall connected between the inlet and the outlet. The inner wall surrounding the blade wheel has at least one rough region. The blade wheel is rotatably disposed in the frame and located between the inlet and the outlet, and an air flows into the frame via the inlet and flows out of the frame via the outlet by rotation of the blade wheel. A gap exists between a blade end of the blade wheel and the inner wall. A laminar flow is generated at the gap when the blade wheel is rotating and the blade end passes through the rough region so as to prevent a backflow generated at the gap, wherein a flowing direction of the backflow is opposite to a flowing direction of the air flow.

6 Claims, 4 Drawing Sheets

AXIAL-FLOW HEAT-DISSIPATION FAN

CROSS-REFERENCE TO RELATED APPLICATION

This application claims the priority benefit of Taiwan application serial no. 112134706 filed on Sep. 12, 2023. The entirety of the above-mentioned patent application is hereby incorporated by reference herein and made a part of this specification.

BACKGROUND

Technical Field

The disclosure relates to a heat-dissipation fan, and in particular relates to an axial-flow heat-dissipation fan.

Description of Related Art

Axial-flow fans have a simple structure and have air supply characteristics of high air volume and low static pressure. Therefore, they are widely used as heat-dissipation fans or ventilation fans for personal computers and servers. Currently, in order to improve the air supply characteristics of axial-flow fans and reduce noise for other optimization purposes, various designs and tests are often conducted on the number of fan blades, the structure of fan blades, or the structure where the air flow passes.

In the above-mentioned adjustment items for the structure where the air flow passes, one of them is to reduce the gap between the fan blades and the frame, thereby reducing the pressure difference between the two opposite surfaces of the blades that causes the backflow of the air flow. However, the above-mentioned gap reduction process, for example, reducing the gap between the blade end and the frame from 1 mm to 0.5 mm, is limited by the precision of the fan component manufacturing and the assembly process. Although it may achieve the desired objective, it results in lower yield rates and increased costs, which is not conducive to mass production.

SUMMARY

An axial-flow heat-dissipation fan is provided in the disclosure, in which backflow is prevented from generating between the blade end and an inner wall of the frame through the rough inner wall of the frame.

The axial-flow heat-dissipation fan of the disclosure is adapted for an electronic device, and includes a frame and a blade wheel. The frame has an inlet, an outlet, and an inner wall connected between the inlet and the outlet. The inner wall surrounding the blade wheel has at least one rough region. The blade wheel is rotatably disposed in the frame and located between the inlet and the outlet, and an air flow generated by rotation of the blade wheel flows into the frame via the inlet and flows out of the frame via the outlet. A gap exists between a blade end of the blade wheel and the inner wall. A laminar flow is generated at the gap when the blade wheel is rotating and the blade end passes through the rough region so as to prevent a backflow generated at the gap. A flowing direction of the backflow is opposite to a flowing direction of the air flow.

Based on the above, for the axial-flow heat-dissipation fan, since at least one rough region is formed on the inner wall of the frame, when the blade wheel rotates and the blade end of the blade wheel passes through the rough region, laminar flow is generated at a gap between the blade end and the inner wall, so that the backflow at the gap is blocked due to the existence of the laminar flow (to prevent the generation of backflow). In this way, compared with the existing method of reducing the gap, which results in poor yield and increased manufacturing costs, the disclosure may effectively prevent backflow with a simple rough structure.

DETAILED DESCRIPTION OF DISCLOSED EMBODIMENTS

Figure 1:
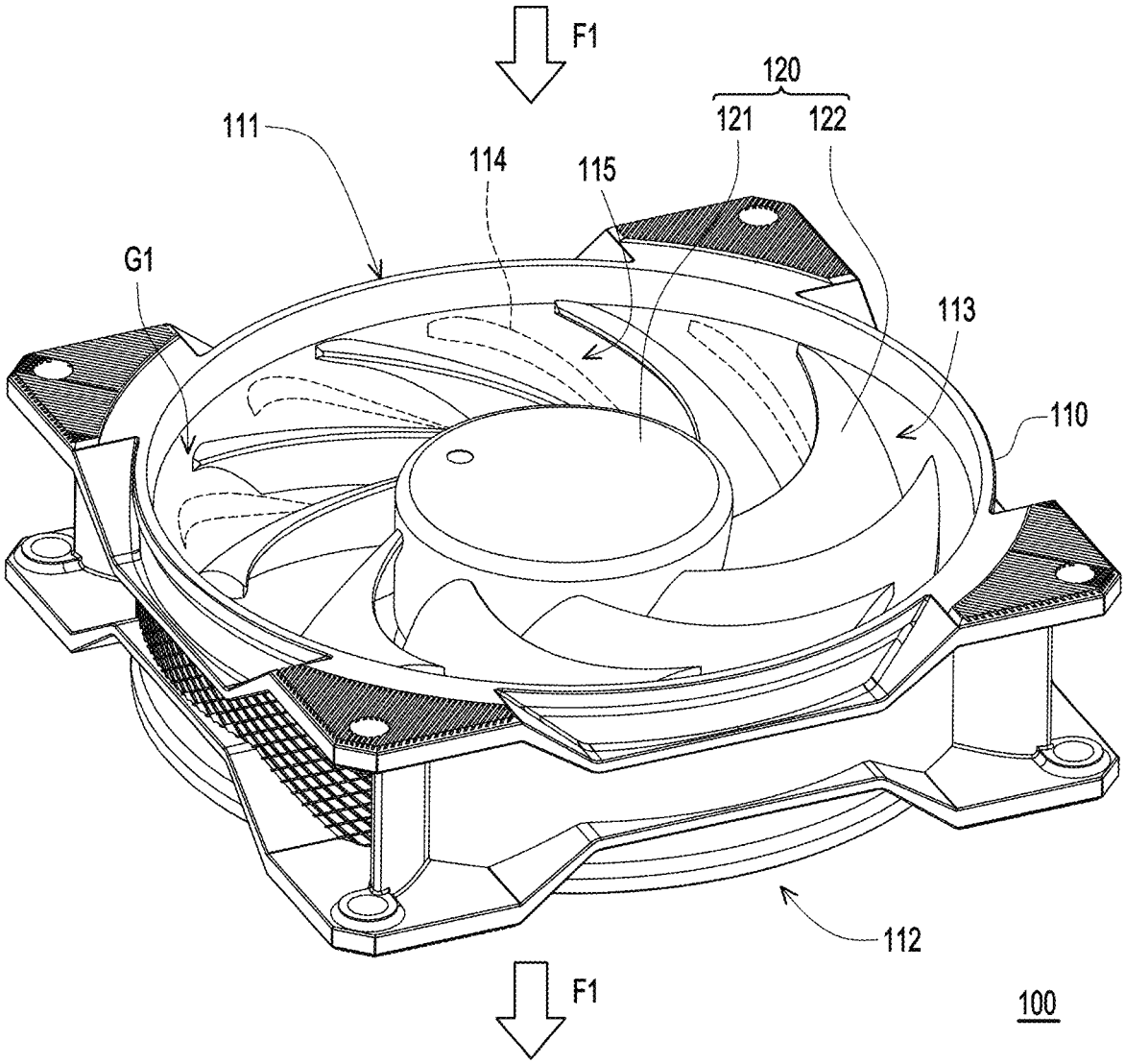
FIG. 1 is a schematic diagram of an axial-flow heat-dissipation fan according to an embodiment of the disclosure.
Figure 2:
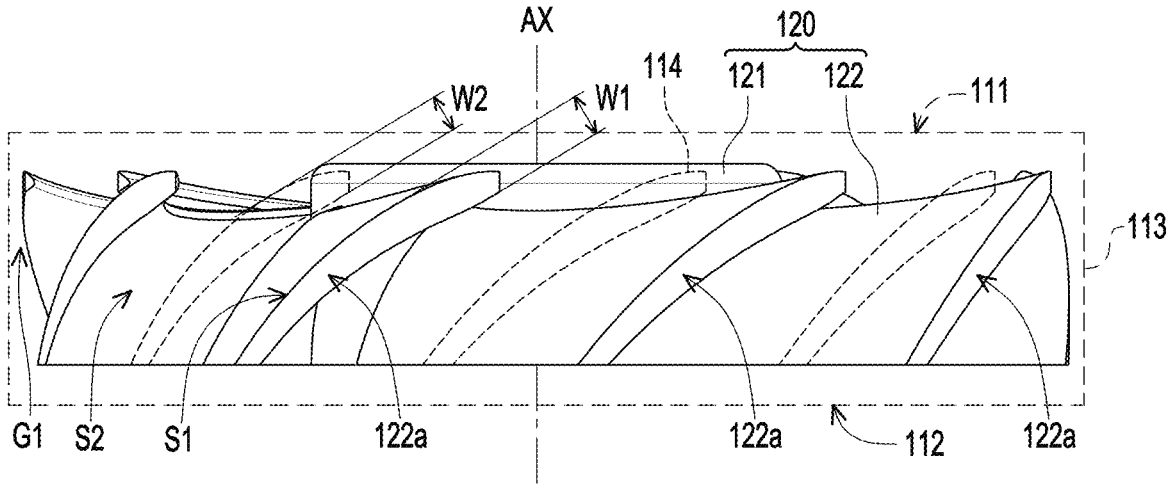
FIG. 2 is a simple side view of the axial-flow heat-dissipation fan.

FIG. 1 is a schematic diagram of an axial-flow heat-dissipation fan according to an embodiment of the disclosure. FIG. 2 is a simple side view of the axial-flow heat-dissipation fan. Referring to FIG. 1 and FIG. 2 at the same time, in this embodiment, the axial-flow heat-dissipation fan 100 is adapted for an electronic device, such as a system fan or a CPU heat-dissipation fan installed in a desktop computer, including a frame 110 and a blade wheel 120. The blade wheel 120 includes a hub 121 and multiple blades 122 surrounding the hub 121. The frame 110 has an inlet 111, an outlet 112, and an inner wall 113. The inner wall 113 is connected between the inlet 111 and the outlet 112, in which the inner wall 113 surrounds the blade wheel 120 and has at least one rough region (multiple rough regions 114 are provided in the drawing as an example, and the range of the rough regions is marked with a dashed line). The blade wheel 120 is rotatably disposed in the frame 110 and is located between the inlet 111 and the outlet 112. The blade wheel 120 is connected through a motor (not shown) and drives the hub 121 to rotate with the axis AX as a reference. When the blades 122 rotate along the axis AX with the hub 121, the air flow F1 is generated to flow into the frame 110 via the inlet 111 and flow out of the frame 110 via the outlet 112.

Figure 3:
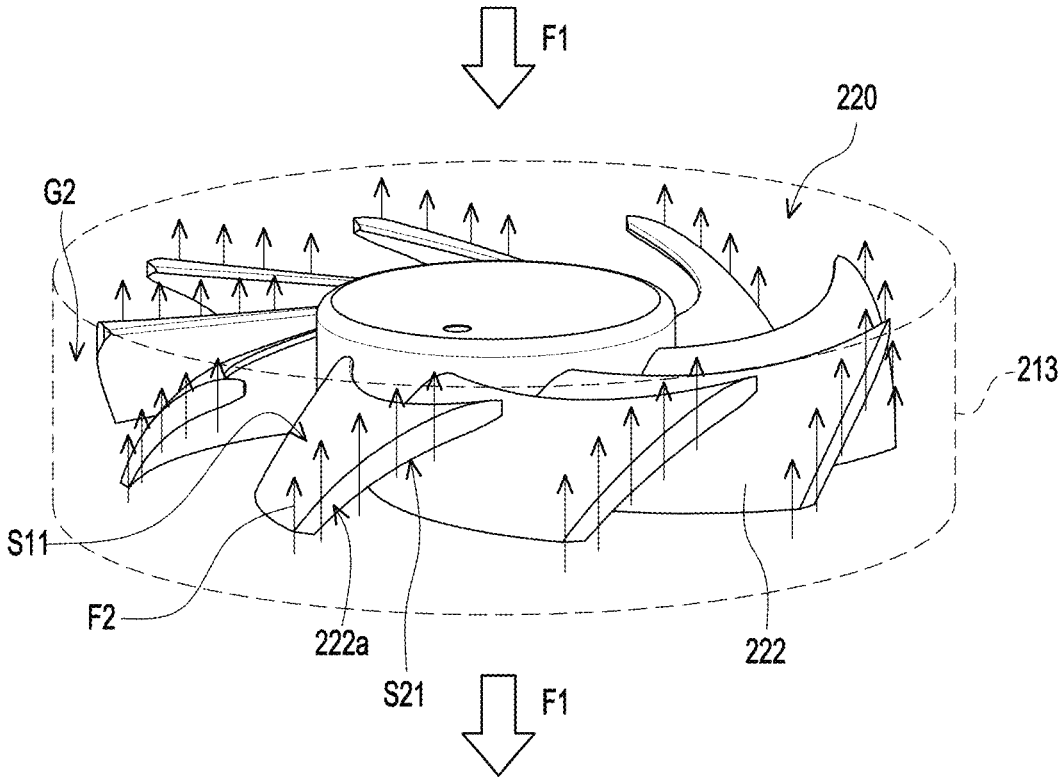
FIG. 3 is a simple schematic diagram of the backflow generated by the current axial-flow fan.

FIG. 3 is a simple schematic diagram of the backflow generated by the current axial-flow fan. Referring to FIG. 3, it should be noted here that a gap G2 exists between the blade end 222*a* of the blade wheel 220 and the inner wall 213 of the frame of the current axial-flow heat-dissipation fan. Therefore, it is inevitable that the blades 222 of the blade wheel 220 have a pressure difference between the air inlet surface S11 and the air outlet surface S21, which causes a backflow F2 to be formed at the gap G2 when the blade wheel 220 rotates, and a flowing direction of the backflow F2 is opposite to a flowing direction of the air flow F1.

Accordingly, in view of the aforementioned method of reducing the gap G2, which may easily lead to poor precision and increased cost, as shown in FIG. 1 and FIG. 2, the disclosure starts with the structure of the frame 110, that is, at least one rough region 114 is formed on the inner wall 113 to generate laminar flow at the gap G1 when the blade wheel 120 rotates.

Figure 4:
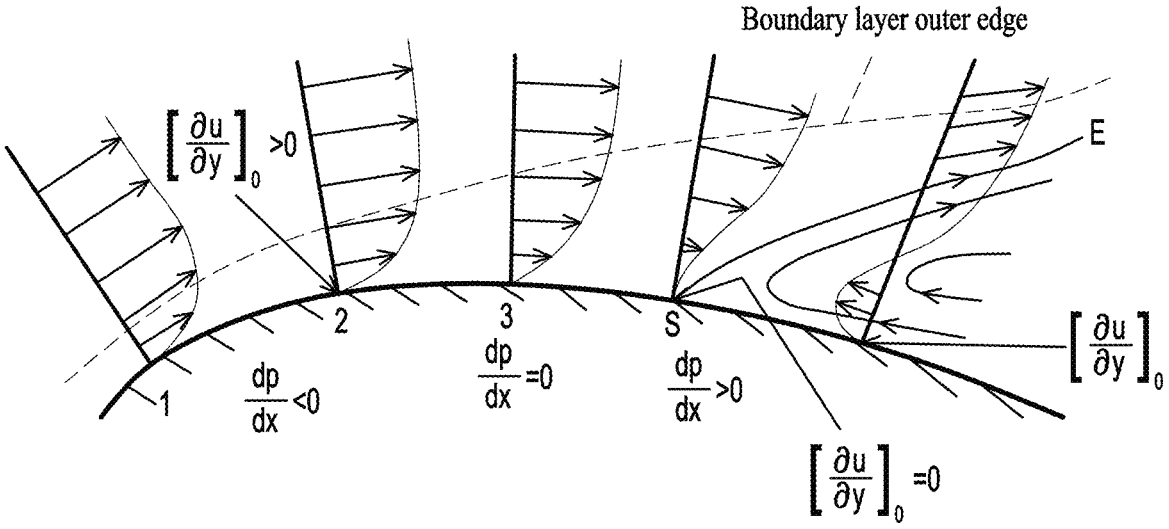
FIG. 4 is a simple schematic diagram of a fluid boundary layer.

FIG. 4 is a simple schematic diagram of a fluid boundary layer. Referring to FIG. 4, the following is a brief description of the formation principle of laminar flow. Generally speaking, the boundary layer formed between the fluid and the object surface is affected by the roughness of the object surface. As shown on the right side of FIG. 4, when the fluid pressure increases, the fluid at the inner edge of the boundary layer gradually generates a reverse flow field E due to the viscous resistance of the object surface, causing the fluid to separate from the object surface. This phenomenon of fluid separation is the main cause of laminar flow.

Here, the boundary layer system of equations:

$$u\frac{\partial u}{\partial x}+v\frac{\partial u}{\partial y}\approx U\frac{\partial U}{\partial x}+\frac{\mu}{\rho}\frac{\partial^2 u}{\partial y^2},$$

when the boundary condition is y=0, u=v=0, when y=∞, u=U(x), where u and v represent the velocity components of the fluid in the x and y directions, U(x) represents the flow rate, u represents the dynamic viscosity (dynamic viscosity coefficient), and p represents the fluid density. The direction along the wall of the object is the x-axis, and the direction perpendicular to the wall is the y-axis.

Based on the above principle of boundary layer separation to form laminar flow, the disclosure forms a rough region 114 on the inner wall 113 of the frame 110, so that laminar flow may be smoothly generated at the gap G1 when the blade end 122*a* passes through the rough region 114. In this way, the generation of laminar flow at a particular location essentially serves to block or reduce backflow (such as the aforementioned backflow F2) occurring at that location. Here, the blade end 122*a* refers to the side surface adjacent between the air inlet surface S1 and the air outlet surface S2 of the blade 122.

Figure 5:
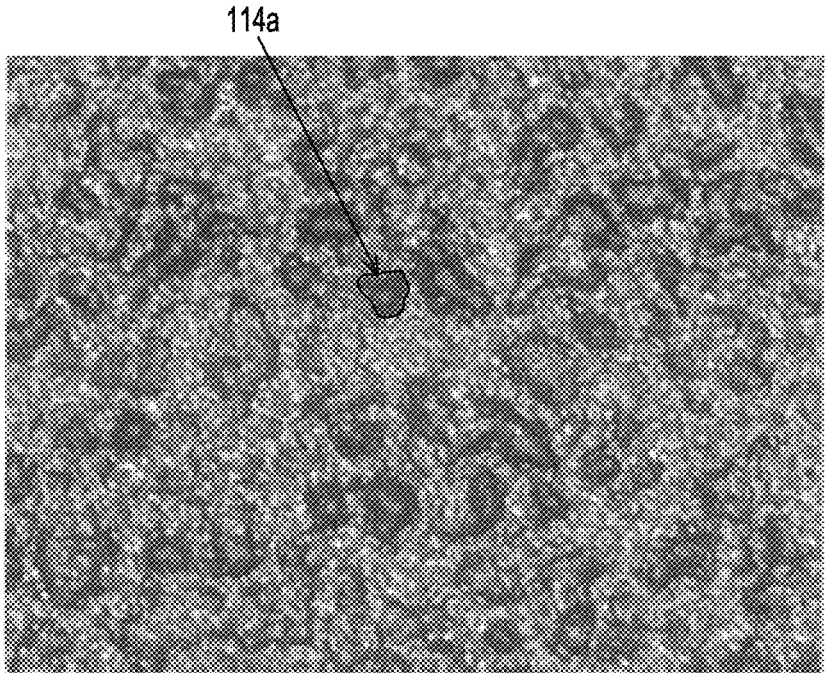
FIG. 5 is a structural schematic diagram of the rough region.

FIG. 5 is a schematic diagram of the structure of the rough region, FIG. 5 is a structural schematic diagram of the rough region, which is shown here as a metallographic image. Referring to FIG. 2 and FIG. 5 at the same time, in this embodiment, the rough region 114 has an etched microstructure and has multiple etching particles 114*a*. The roughness of the rough region 114 is defined by the etching depth of the etched microstructure of 10 μm to 45 μm and the etching particles 114*a* of 15 to 150 per centimeter to ensure the generation of laminar flow. The above-mentioned etching is for the mold that forms the inner wall 113. By forming the etching pattern on the mold, the corresponding pattern may be successfully formed on the inner wall 113.

Referring to FIG. 1 and FIG. 2 again, in this embodiment, although the formation of the rough region 114 facilitates the generation of laminar flow, it also reduces the overall flow rate of the air flow F1 due to increased friction. Accordingly, the disclosure further provides relevant conditions to optimize the characteristics of the rough region 114. In one embodiment, the inner wall 113 of the frame 110 has multiple rough regions 114, and the number of the rough regions 114 is greater than or equal to the number of the blades 122 of the blade wheel 120. Taking FIG. 1 as an example, the blade wheel 120 has nine blades, so the number of rough regions 114 on the inner wall 113 is greater than or equal to nine.

Furthermore, as shown in FIG. 2, laminar flow is generated due to changes in the air flow at the gap G1 (by the boundary layer separation), therefore, it substantially depends on the blade end 122*a* and the inner wall 113, so the outline of the rough region 114 is substantially based on the blade end 122*a*. To be more specific, the rough region 114 is formed by orthogonally projecting the outline of the blade end 122*a* onto the inner wall 113. Therefore, the width W2 of the rough region 114 is substantially adjusted based on the width W1 of the bladed end 122*a*. Based on the above description about the number of rough regions 114, when the number of rough regions 114 is equal to the number of blades 122, the minimum width W2 of the rough region 114 is greater than or equal to the width W1 of the orthogonal projection outline 122*b* of the blade end 122*a* projected onto the inner wall 113. When the number of rough regions 114 is greater than the number of blades 122, the minimum width W2 of the rough regions 114 is less than the width W1 of the outline of the blade end 122*a* projected onto the inner wall 113.

In other words, in this embodiment, the number of rough regions 114 serves as the basis for adjusting the width W2 of the rough regions 114. When the number of rough regions 114 is relatively small (e.g., the number of rough regions 114 is equal to the number of blades 122), the width W2 of the rough regions 114 may be greater than or equal to the width W1 of the orthographic projection outline of the blade end 122*a* projected onto the inner wall 113. Conversely, when the number of rough regions 114 is relatively large (e.g., the number of rough regions 114 is greater than the number of blades 122), the width W2 of the rough regions 114 may be appropriately reduced so that the width W2 of the rough regions 114 is less than the width W1 of the orthographic projection outline of the blade end 122*a* projected onto the inner wall 113.

Furthermore, the number and width W2 of the rough regions 114 may be adjusted based on the area ratio to the inner wall 113. That is, after determining the total area of these rough regions 114 according to requirements, the width W2 of the rough regions 114 is adjusted according to the number of blades 122 as a means for optimizing the rough regions 114. It should be noted that the aforementioned area ratio is based on the area of the inner wall 113 swept by the blade end 122*a* when the blade 122 rotates.

Referring to FIG. 1 and FIG. 2 again, in this embodiment, the rough region 114 is parallel to or consistent with the outline of the blade end 122*a* projected onto the inner wall 113. This is equivalent to forming rough regions 114 and smooth regions 115 on the inner wall 113, which are staggered with each other and in a consistent tilt orientation (also consistent with the blade end 122*a*). This allows the blade end 122*a* to generate laminar flow only when passing through the rough region 114, but may achieve a wider range of laminar flow due to the large overlapping region of the rough region 114 and the orthographic projection outline of the blade end 122*a* on the inner wall 113.

Figure 6:
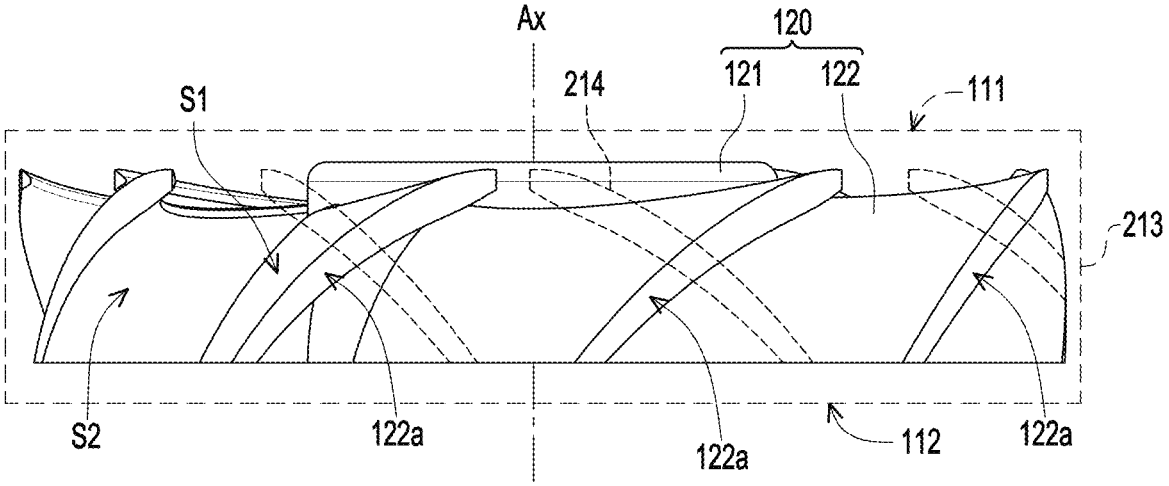
FIG. 6 is a simple side view of an axial-flow heat-dissipation fan of another embodiment of the disclosure.

FIG. 6 is a simple side view of an axial-flow heat-dissipation fan of another embodiment of the disclosure. Referring to FIG. 6, different from FIG. 2, the rough region 214 on the inner wall 213 is perpendicular to the orthogonal projection outline of the blade end 122*a* onto the inner wall 213. This increases the probability that the blade end 122*a* will sweep through the rough region 214, thereby facilitating the coverage of the region that the blade end 122*a* will sweep over with the least amount of rough region 214.

Comparing FIG. 2 and FIG. 6 at the same time, the difference lies in the configuration of rough regions 114 and 214, respectively, in relation to the sweeping of the blade end 122*a*. The rough region 114 may form a larger sweep region (equivalent to covering a gap with a larger range), while the rough region 214 increases the sweep probability by reducing the area of the sweep region (equivalent to more sweeps per unit time). Designers may adjust or mix and match them on the inner wall of the same frame according to actual requirements.

To sum up, in the embodiment of the disclosure, for the axial-flow heat-dissipation fan, since at least one rough region is formed on the inner wall of the frame, when the blade wheel rotates and the blade end of the blade wheel passes through the rough region, laminar flow is generated at a gap between the blade end and the inner wall, so that the backflow at the gap is blocked due to the existence of the laminar flow. In this way, compared with the existing method of reducing the gap, which results in poor yield and increased manufacturing costs, the disclosure may effectively prevent backflow with a simple rough structure.

Furthermore, designers may adjust the number and width of the rough regions according to requirements, or adjust the sweeping relationship between the rough regions and the blade end according to the configuration orientation. In one embodiment, the rough region may be parallel or consistent with the outline of the blade end projected onto the inner wall to generate a wider range of laminar flow through a larger sweep region. In another embodiment, the rough region may be arranged to be perpendicular to the orthogonal projection outline of the blade end projected onto the inner wall, so as to increase the number of times laminar flow is generated per unit time. Designers may adjust and optimize the rough region and its sweeping relationship with the blade end according to requirements.

What is claimed is:

1. An axial-flow heat-dissipation fan, adapted for an electronic device, comprising:

a frame, having an inlet, an outlet, and an inner wall connected between the inlet and the outlet, wherein the inner wall has at least one rough region; and a blade wheel, rotatably disposed in the frame and located between the inlet and the outlet, the inner wall surrounding the blade wheel, an air flow generated by rotation of the blade wheel flows into the frame via the inlet and flows out of the frame via the outlet, wherein a gap exists between a blade end of the blade wheel and the inner wall, a laminar flow is generated at the gap when the blade wheel is rotating and the blade end passes through the at least one rough region so as to prevent a backflow generated at the gap, a flowing direction of the backflow is opposite to a flowing direction of the air flow, wherein the at least one rough region has an etched microstructure, and a roughness of the at least one rough region is defined by an etching depth of the etched microstructure of 10 μm to 45 μm and etching particles of 15 to 150 per centimeter.

2. The axial-flow heat-dissipation fan according to claim 1, wherein the at least one rough region is parallel to or consistent with an outline of the blade end orthogonally projected onto the inner wall.

3. The axial-flow heat-dissipation fan according to claim 1, wherein the at least one rough region is perpendicular to an outline of the blade end orthogonally projected onto the inner wall.

4. The axial-flow heat-dissipation fan according to claim 1, wherein the at least one rough region of the inner wall comprises a plurality of rough regions, and a number of the rough regions is greater than or equal to a number of blades of the blade wheel.

5. The axial-flow heat-dissipation fan according to claim 1, wherein the at least one rough region of the inner wall comprises a plurality of rough regions, when a number of the rough regions is equal to a number of blades of the blade wheel, a minimum width of the rough regions is greater than or equal to a width of an outline of the blade end orthogonally projected onto the inner wall.

6. The axial-flow heat-dissipation fan according to claim 1, wherein the at least one rough region of the inner wall comprises a plurality of rough regions, when a number of the rough regions is greater than a number of blades of the blade wheel, a minimum width of the rough regions is less than a width of an outline of the blade end orthogonally projected onto the inner wall.

* * * * *